United States Patent [19]

Cornish et al.

[11] Patent Number: 4,688,369

[45] **Date of Patent: * Aug. 25, 1987**

[54] APPARATUS AND METHOD FOR PRESSURE RESIZING OF PRODUCTS

[75] Inventors: Darrell G. Cornish, McFarland; Carroll P. Hartl, Madison, both of Wis.

[73] Assignee: Oscar Mayer Foods Corporation, Madison, Wis.

[ * ] Notice: The portion of the term of this patent subsequent to Oct. 25, 2000 has been disclaimed.

[21] Appl. No.: 756,934

[22] Filed: Jul. 19, 1985

Related U.S. Application Data

[63] Continuation of Ser. No. 530,017, Sep. 7, 1983, abandoned, which is a continuation of Ser. No. 152,759, May 23, 1980, Pat. No. 4,411,122.

[51] Int. Cl.[4] ..... B65B 63/02

[52] U.S. Cl. ..... 53/436; 53/122; 53/438; 53/467

[58] Field of Search ..... 53/107, 436, 122, 438, 53/321, 467, 368, 523, 527, 526

[56] References Cited

U.S. PATENT DOCUMENTS

| | | | |
|---|---|---|---|
| 2,012,529 | 8/1935 | Eldredge | 53/122 |
| 2,224,908 | 12/1940 | Griffith | 53/368 |
| 2,481,611 | 9/1949 | Moore . | |
| 2,811,818 | 11/1957 | McCarty | 53/321 |
| 2,938,801 | 5/1960 | Seiferth et al. | 426/129 |
| 3,065,584 | 11/1962 | Coleman | 53/122 |
| 3,498,018 | 3/1970 | Seiferth et al. | 53/436 |
| 3,524,297 | 8/1970 | Falborg et al. | 53/438 |
| 3,548,890 | 12/1970 | Langen | 53/529 |
| 3,688,464 | 9/1972 | Fox | 53/436 |
| 3,754,372 | 8/1973 | Perdue . | |
| 3,864,891 | 2/1975 | Piereder | 53/122 |

FOREIGN PATENT DOCUMENTS

| | | | |
|---|---|---|---|
| 529513 | 6/1954 | Belgium | 53/122 |
| 1381075 | 10/1964 | France | 53/436 |
| 49-23724 | 6/1974 | Japan . | |
| 53-537 | 1/1978 | Japan . | |
| 53-21685 | 2/1978 | Japan . | |

*Primary Examiner*—Robert L. Spruill
*Assistant Examiner*—Steven P. Weihrouch
*Attorney, Agent, or Firm*—Joseph T. Harcarik; Thomas R. Savoie; Daniel J. Donovan

[57] ABSTRACT

Deformable products (that is, resizable products) which are within preformed packages are resized by the application of mechanical forces so that the products substantially conform to the size and shape of the inside surface of the package. Such resizing is accomplished by an apparatus and method utilizing a pressure generating member to apply a preselected force to the product in cooperation with a restrained cavity concept, whereby the force applied is directed and restrained to resize the product to substantially the same size and shape as the inside surface of the package. Such apparatus and method may be useful before, during or after closing the package.

11 Claims, 8 Drawing Figures

APPARATUS AND METHOD FOR PRESSURE RESIZING OF PRODUCTS

This application is a continuation of application Ser. No. 530,017, filed Sept. 7, 1983 now abandoned, which is a continuation of Ser. No. 152,759, filed May 23, 1980 now U.S. Pat. No. 4,411,122.

This invention relates generally to the pressure resizing of products.

This invention is especially suitable for the pressure resizing of deformable products within flexible, semi-rigid or rigid preformed plastic packages, such as meat or other food products that are marketed within "bubble" packages having a body or "bubble" sealed onto a relatively flat panel or closure member. Various aspects of this invention include a method and apparatus employing a restrained cavity concept in combination with a pressure generating means, whereby the invention effects a resizing of a deformable product so that the product conforms substantially to the size and shape of the package.

Deformable products, particularly food products such as processed meats, typically cannot be produced to have consistently uniform dimensions. To provide commerical packaging for such products in a wide variety of sized in an attempt to match the packaging to the size and shape of the particular product is not economically feasible.

For example, sausages and other luncheon meats are initially produced in the form of large encased sausage chubs or long loaves that vary in size and shape, especially cross-sectional area, throughout their lengths. The typical sausage product, for example, has a cross-sectional area that is narrower at the ends than near the longitudinal center. When such processed meat products are packaged and sold at a uniform, predetermined weight, the dimensions of one product unit may vary from the dimensions of a second product unit, the perimeter size and the height being dependent upon which portion of the chub or loaf is utilized. In addition to variation within an individual sausage chub or loaf, there is also variation from chub to chub or loaf to loaf because of non-uniform cooking yields, misshapen forms, product density differences, and variations in knockout temperatures and blast-chill conditions.

The greater the variations in dimensions, the greater is the frequency of the packaged product being rejected because the packages are deformed or the product is damaged in some way. Typical package defects include:

- buckling—a severe concaving of package side walls which creates sharp creases in the packaging material;
- paneling—a concaving of the package side wall;
- bulging—a convexing of the package side wall or the top surface;
- dishing—a concaving of the package top surface, when the package is vacuum-sealed around a product having a shape and size different from the package. Other reasons for package rejection include the migration of product into the seal area of the package and the collection of moisture within sealed packages after storage.

To overcome these problems, one approach that has been taken is attempting to improve the uniformity of dimensions of the product, such attempts including utilizing colder knock-out temperatures and using closely dimensioned tolerance forms.

Another approach includes attempting to uniformly reshape the formed loaf before slicing and packaging, whereby the loaf would be confined within a uniformly sized form for a length of time. However, after slicing, the loaf tends to revert to the dimensions of the initially formed loaf, possibly because the loaves have a "memory" of their initial dimensions.

Methods for packaging products within preformed plastic packages are well known. Two known approaches are found in Goller et al U.S. Pat. No. 3,229,810 and Seiferth et al U.S. Pat. No. 3,498,018, and these disclosures are incorporated by reference into this application. Packages produced according to these patents can be further improved, according to this invention, so as to lessen the frequency and level of packaged product rejects due to package deformities and product damage.

By the present invention, a mass of a deformable product is resized before, during or after packaging within a preformed and uniformly sized package. This invention utilizes a restrained cavity concept in combination with the application of a preselected force to the product, the pressure preferably being applied to the end of the product mass that is opposite the product end which is associated with closure of the package, whereby the product mass is resized into substantial conformity with the inside surface of the package to the extent that defects in the sealed package are significantly reduced without causing substantial damage to the product.

Accordingly, a general object of this invention is to provide an apparatus and method for pressure resizing of products.

Another object of the present invention is to provide an improved method and apparatus for packaging deformable products within flexible, semi-rigid and rigid packages.

Another object of this invention is an improved apparatus and method utilizing a restrained cavity concept useful in resizing a deformable product while avoiding any substantial damage to the package in which the product is sealed.

Another object of the present invention is an improved method and apparatus in which a preselected movable force is imparted to a deformable product in order to assist in resizing that product to a predetermined cross-sectional area and height.

Another object of the present invention is an improved method and apparatus which includes the utilization of cavity wall restraints in combination with pressure application means whereby forces are exerted onto a deformable product within the cavity.

Another object of the present invention is to provide an apparatus and method for reducing the frequency of sealed product rejects during commercial-scale hermetic sealing of preformed packages containing a deformable product, especially a food product.

These and other objects of this invention will become apparent from the following detailed description and the accompanying drawings.

Figure 1:
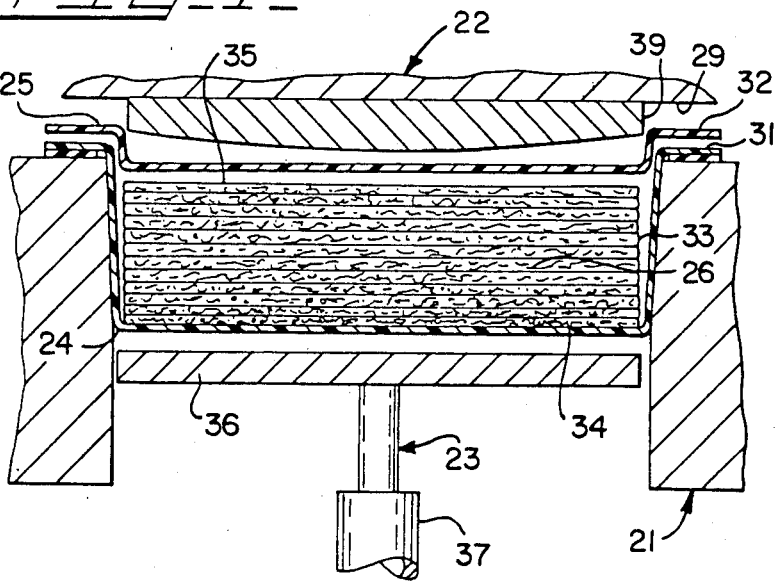
FIG. 1 is an exploded sectional view through the preferred apparatus or processing station of this invention.
Figure 2:
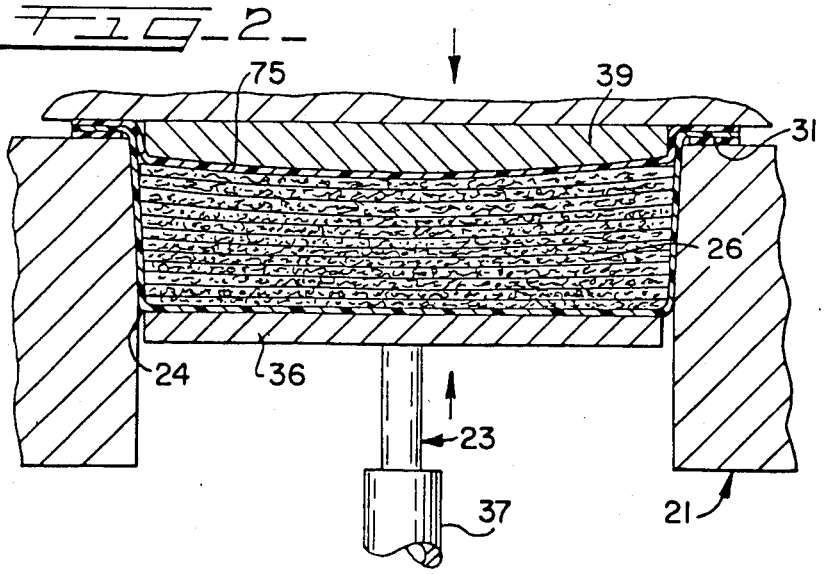
FIG. 2 is a sectional view of the apparatus shown in FIG. 1, illustrating sealing of the bubble to the base, while simultaneously resizing the product within the bubble.

The preferred resizing apparatus illustrated in FIGS. 1 and 2 includes a cavity, generally illustrated as reference numeral 21, a closure end restraint member, generally designated as 22, and pressure generating means, generally designated as 23. Also illustrated is a semi-rigid preformed package including a body member 24 and a closure panel 25, a deformable product 26 being located within the package.

Cavity 21 also functions as a unitary side wall restraint member, which may be metal (such as stainless steel) or natural or synthetic rubber. The internal size and shape of the side wall restraint member is substantially the same as the external size and shape of the package body member 24 to the extent that gaps between the side wall restraint member and the package body member 24 are substantially eliminated. Often, the package body member 24 will, as illustrated and in order to permit ease of removal of the product, have a slight broadening taper toward the closure panel 25; in such case, the side wall restraint member will have a complementary taper.

Closure end restraint member 22 includes a height restraint member 39 which, together with the side wall restraint member, comprises the restrained cavity of this embodiment. Preferably, height restraint member 39 is a member made of a material within the class of materials of which the side wall restraint member may be made. Height restraint member 39 serves to provide a compressive force onto the deformable product 26, which force has, in addition to a directional component along the height of the deformable product 26, a generally radial directional component to impart resizing forces to the product 26 that will increase the size of the product's perimeter until the product is substantially the same size and shape as the package body member 24.

Development of this radial or peripherally directional force component is enhanced by including inwardly tapering surfaces on height restraint member 39, such surfaces being tapered toward the central height of the product 26.

Closure end restraint member 22 typically also includes a sealing member 29 of conventional construction to apply energy, usually heat energy, to the marginal flange 31 of the body member 24 and a peripheral flange 32 of the closure panel 25. A pressure sensitive or heat sensitive adhesive may be positioned between the marginal flange 31 and the peripheral flange 32 in accordance with conventional sealing techniques for these types of packages. By this structure, the marginal flange 31 and the peripheral flange 32 are hermetically sealed together, typically in conjunction with conventional air evacuation of the package, while the height restraint member 39 cooperates with the side wall restraint member and the pressure generating means 23 in order to resize the product 26 as desired. Various sizes and shapes of additional restraint members can be included on closure end restraint member 22 to help maintain the size and shape of the closure panel 25 during sealing. Ultrasound techniques or direct film-to-film contact can also be used to seal the package.

The product 26 includes a side surface 33, an end surface 34, and a closure surface 35 which is in contact with the inside surface of closure panel 25. The end surface 34 is opposite closure surface 35.

Pressure generating means 23 includes a pusher plate 36 for exerting a pushing force through the package body member 24 onto the product end surface 34, which pushing force cooperates with forces provided by the side wall restraint member and the height restraint member 39. In this embodiment of the pressure generating means 23, the pushing force is provided by a telescoping pusher means such as reciprocable cylinder 37, which is preferably an air activated cylinder.

Figure 3:
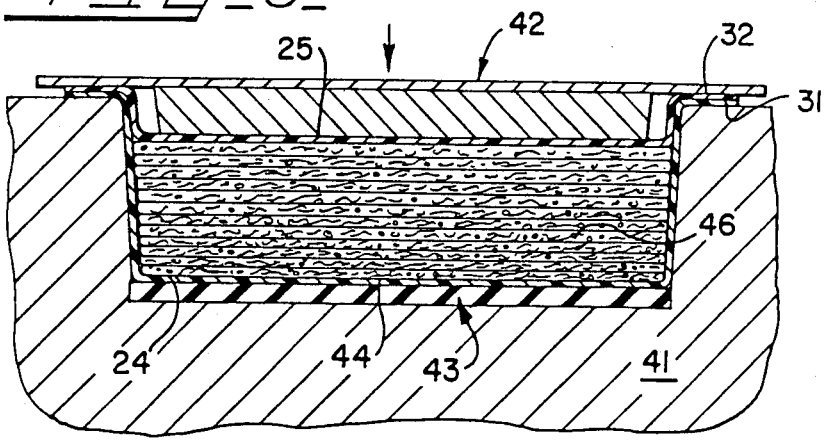
FIG. 3 is a sectional view of an alternative embodiment in which the restrained cavity feature and the pressure application concept are incorporated directly into the cavity.

In the embodiment illustrated in FIG. 3, cavity 41 also functions as a unitary side wall restraint member, and closure end restraint member 42 also functions as a unitary height restraint member. Cavity 41 has an inside surface of substantially the same size and shape as the outside surface of package body member 24. Closure end restraint member 42 exerts a force that has directional components through the height and toward the periphery of the deformable product 46. If desired, each of cavity 41 and closure end restraint member 42 can exhibit resiliency in order to enhance resizing of the product 46. Resizing is accomplished in this embodiment when closure end restraint member 42 is closed onto the cavity 41, which cavity 41 is height undersized to a variable, preselected degree by insertion of pressure generating means 43 which imparts the desired amount of pushing force to the end surface 44 of the product 46.

The preferred embodiment illustrated in FIGS. 1 and 2 simultaneously resizes the product 26 and closes the package. The embodiment illustrated in FIGS. 4 and 5 first resizes the product either within a package body member or, as depicted, within a cavity 51 in the absence of a package, after which the resized product 56 is sealed within a package. More particularly, at the first station shown in FIG. 4, closure end restraint member 52 has no sealing means but also functions as a unitary height restraint member. Cavity 51 also functions as a unitary side wall restraint member which can directly contact the deformable product when the package is omitted as shown. The first station forms the defomable product into the resized product 56 which has the shape and size of the cavity 51, and the internal surface of cavity 51 is shaped and sized to be substantially the same as the inside surface of a package body member 64 as shown in FIG. 5.

At a second station (FIG. 5), the shaped and resized product 56 is inserted into package body member 64 and then into cavity 61 in which the resized product 56 is sealed by conventional means such as a sealing bar 69 which joins the package body member 64 to a closure panel 65. Cavity 61 preferably includes a support plate 63 in order to maintain the size and shape of the closure panel 65 while being sealed onto the package body member 64.

Figure 6:
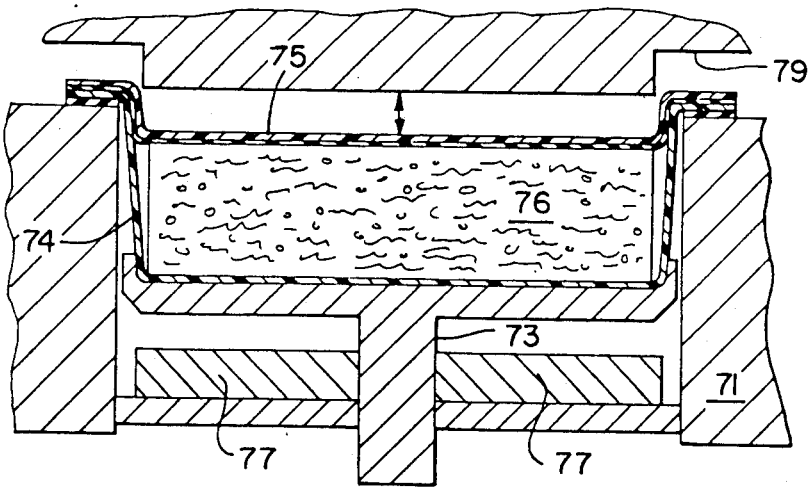
FIG. 6 is a sectional view of yet a further alternative embodiment, this view illustrating the step of first closing a package with a closure panel or base, the package containing a non-resized product.
Figure 7:
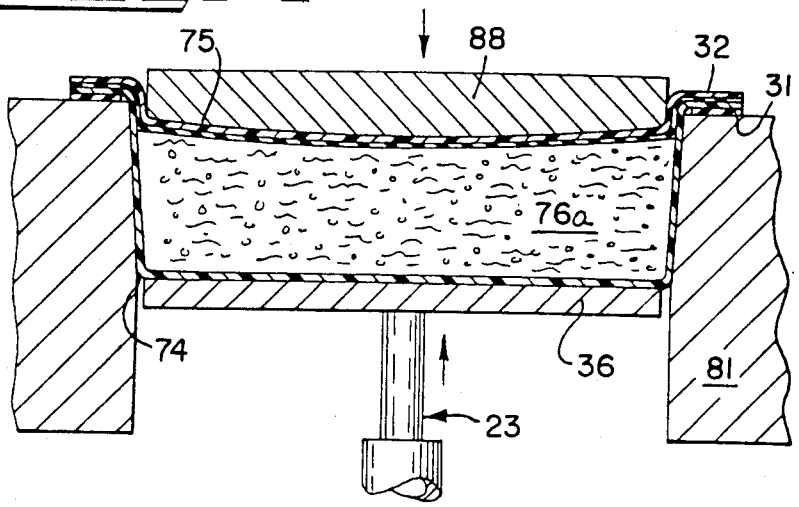
FIG. 7 is a sectional view of the embodiment illustrated in FIG. 6, this view showing resizing of the product while within the package.

By the embodiment illustrated in FIGS. 6 and 7, a preformed semi-rigid package is first closed to hermetically seal a non-resized deformable product 76. Cavity 71 includes a support plate 73 that can be adjusted in height by spacers 77. Support plate 73 supports a package body member 74 when being sealed to a closure panel 75 by a sealing bar 79. Next, the sealed package of non-resized product 76 is moved from cavity 71 to cavity 81 (FIG. 7) having a structure substantially the same as that of FIG. 1, except that sealing bar 29 is omitted. Movement of pusher plate 36 and height restraint member 88 in directions opposite to each other provides the force required to resize product 76*a*.

Figure 8:
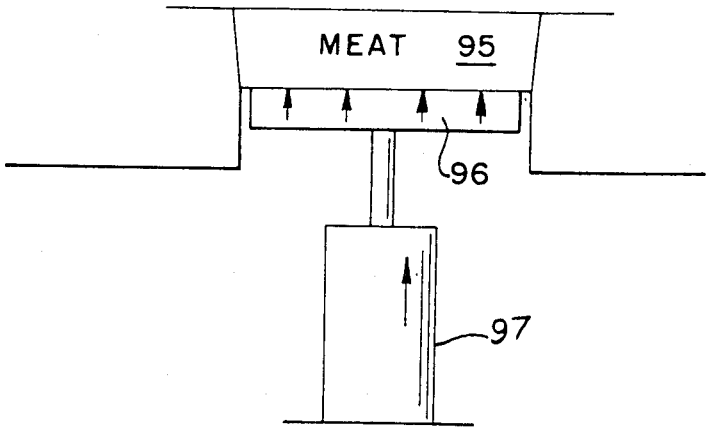
FIG. 8 is a schematic view of the preferred pressure generating means.

Pressure generating means illustrated in FIG. 8 includes a pusher plate 96 that is moved by a reciprocable cylinder 97, and a deformable product 95 is resized by an upward stroke of the reciprocable cylinder 97.

In proceeding with the method according to this invention, a quantity of a product is pressure resized into substantial conformity with the inside surface of a preformed plastic package by placing the product into a cavity having side wall restraint to movement beyond the dimensions of the package. Next, a force is applied to restrain a closure surface of the product and to impart a force to an end surface of the product opposite that of the closure surface, whereby the product is resized to conform substantially to the size and shape of the cavity.

Deformable products resized according to this invention are typically of a substantially uniform weight, but vary from each other in densities, compositions and dimensions. By the present process, such variations are substantially eliminated in order to provide a resized product of generally uniform dimensions as well as weight. The product is usually an upright mass of a food item such as stacked slices of luncheon meats.

In the preferred embodiment of the method of this invention, the step of placing the product into a cavity includes placing the product into a semi-rigid preformed package body member having a side wall, an end wall, and a closure end opposite the end wall. The closure end is, after product is inserted, sealed by a closure panel. A closure force applying step begins either before, after or simultaneously with the step of imparting a preselected force to the end surface of the product.

The forces necessary to resize products according to this invention will be determined by the product characteristics (such as density, composition, temperature, weight, dimensions, shape, etc.).

When proceeding with an alternative embodiment of this invention, deformable product having a generally uniform weight but a generally non-uniform outside surface configuration is placed into a resizing cavity having an internal size and shape substantially identical with the internal size and shape of a semi-rigid preformed plastic package. The cavity provides side wall restraint and a top or closure surface restraint which imparts height restraint forces to a central core, but not the periphery, of the cavity. A preselected force is provided at the end surface of the product, typically generally uniformly throughout the end surface, and the product is resized to substantially the size and shape of the cavity. The resized product is then inserted into the package, after which the package is hermetically sealed, preferably in conjunction with an air evacuation step.

If desired, the cavity can contain a bubble or body member of the package, which body member is then useful for transferring the resized product from out of the resizing cavity and into the sealing station in order to seal an appropriate closure panel to the body member.

By another alternative embodiment of this invention, a non-resized product is first sealed within a bubble or package body member, and a closure panel is hermetically sealed to the member by conventional means, after which a resizing operation in accordance with this invention is accomplished. Such resizing includes providing side wall restraint and top or closure wall restraint, generally in accordance with the other embodiments of this invention.

These various alternative embodiments permit variations in steps according to available processing facilities. However, the preferred embodiment of the method is particularly advantageous because the resizing and closure functions are performed at a single station and, in effect, as a single step, while the various alternative embodiments require two manufacturing stations and two separate processing steps.

The finally packaged products produced according to the apparatus and method of the invention exhibit several improvements and advantages over products produced without the resizing features. The following specific examples more precisely illustrate the improvements and advantages realized by this invention.

EXAMPLE I

Comparative tests were run using two different single cavity devices, one device (Resizer A) having a structure as generally illustrated in FIG. 3, and the other device (Control A) being substantially the same as Resizer A, except that Control A did not have a side wall restraint member in engagement with the package body and did not have a closure surface restraint member and a pressure generating means actively applying pressure to the respective top and bottom surface of the meat product. To this extent, Control A was substantially the same as the device illustrated in FIGS. 3–5 of U.S. Pat. No. 3,498,018. Five different varieties of sliced luncheon meats were inserted in a body member within the cavity of each device, and a closure panel was positioned over the opening of the body member and then sealed to the body member, each body member and closure panel having a structure as illustrated in FIG. 3.

More particularly, eight and twelve ounce stacks of sliced square luncheon meats, as manufactured at a commercial meat processing facility, were re-weighed. Each stack was inserted into a conventional bubble or body member (made of Barex plastic material) and then placed in either (1) Resizer A and resized according to this invention or (2) Control A and not resized. Each package was air evacuated and heat sealed. After closing, packages of each product were evaluated for package quality. Packaging defects such as paneling (greater than 2/32 inch), buckling (using "fingernail" test), dishing, and observation of meat in the seal were recorded and are reported in Table I (where "n" refers to the number of packages).

TABLE I

| | Product 1 | Product 2 | Product 3 | Product 4 | Product 5 |
|---|---|---|---|---|---|
| | | Resizer A | | | |
| n | 35 | 25 | 25 | 40 | 40 |
| Paneled | 3% | 0% | 3% | 5% | 0% |

TABLE I-continued

| | Product 1 | Product 2 | Product 3 | Product 4 | Product 5 |
|---|---|---|---|---|---|
| Buckled | 0% | 0% | 0% | 0% | 0% |
| Dished | 3% | 0% | 0% | 0% | 0% |
| Meat in Seal | 0% | 12% | 0% | 0% | 5% |
| | | | Control A | | |
| n | 35 | 25 | 25 | 40 | 40 |
| Paneled | 14% | 4% | 28% | 50% | 13% |
| Buckled | 9% | 4% | 24% | 32% | 8% |
| Dished | 3% | 0% | 12% | 8% | 3% |
| Meat in Seal | 0% | 0% | 0% | 0% | 0% |

The data of Table I illustrate that reject levels were significantly lower for packaged products made in Resizer A than those made in Control A, with exception of the meat in the seal test for two of the five luncheon meats tested in which overfill (greater than 12/32 ounce) and warm product were factors influencing the results of this test.

EXAMPLE II

Figure 4:
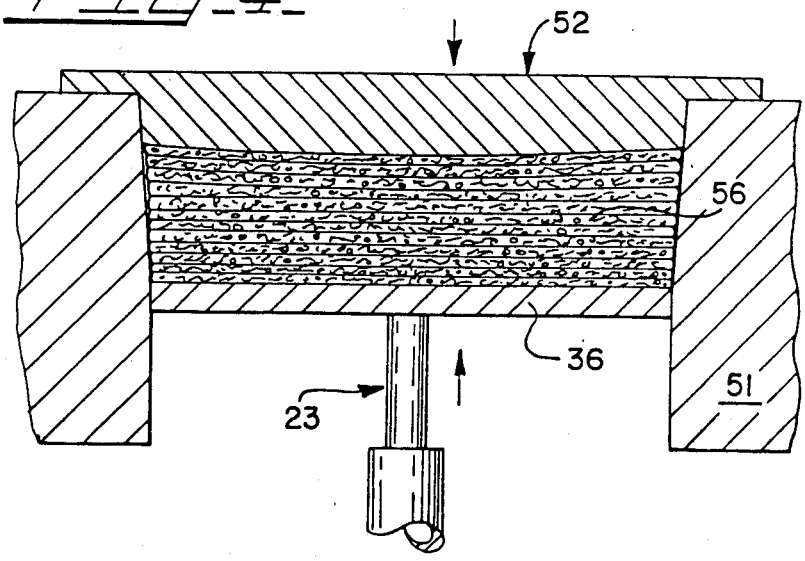
FIG. 4 is a sectional view of another alternative embodiment in which the product is resized before closing the package.
Figure 5:
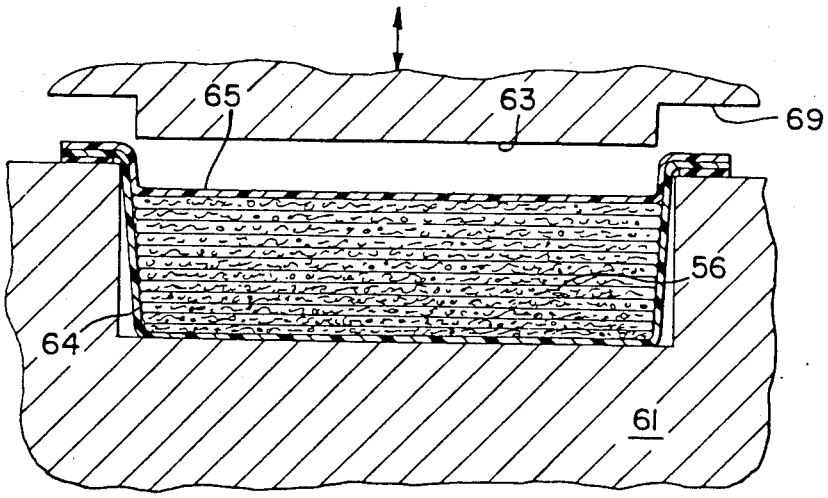
FIG. 5 is a sectional view of the embodiment illustrated in FIG. 4 showing the second step of that embodiment whereby the resized product is sealed within a package having a bubble and a base.

Additional comparative testing was carried out with one device (Resizer B) being substantially as illustrated in FIGS. 1 and 2 and the other device (Control B) being similar to that of FIGS. 3–5 of U.S. Pat. No. 3,498,018. Control B was also similar to the apparatus as shown in FIGS. 1 and 2 of this application but from which the side wall restraint member, the closure surface restraint member and the pressure generating means were omitted.

Eight ounce stacks of five different luncheon meats were packaged as described in Example I on either Resizer B or Control B. The setting of the reciprocal cylinder for Resizer B was varied depending upon overfill or temperature variation factors that were apparent for the differing luncheon meats so that the pusher plate would provide the optimum force needed for resizing. The amount of force needed was usually more dependent upon product temperature than extent of overfill. Again, "n" refers to the number of packages.

TABLE II

| | Product 6 | Product 7 | Product 8 | Product 9 | Product 10 |
|---|---|---|---|---|---|
| | | | Resizer B | | |
| n | 40 | 40 | 60 | 40 | 40 |
| Paneled | 0% | 3% | 3% | 0% | 5% |
| Buckled | 0% | 0% | 0% | 0% | 0% |
| Dished | 0% | 0% | 0% | 0% | 0% |
| Meat in Seal | 3% | 0% | 0% | 0% | 0% |
| | | | Control B | | |
| n | 40 | 40 | 60 | 40 | 40 |
| Paneled | 8% | 30% | 33% | 25% | 43% |
| Buckled | 5% | 13% | 20% | 13% | 23% |
| Dished | 0% | 5% | 7% | 8% | 5% |
| Meat in Seal | 0% | 0% | 0% | 0% | 0% |

Products packaged by Resizer B had significantly lower reject levels than those using Control B. Meat in the seal for the Resizer B products was substantially eliminated, primarily because of the adjustments to the pressure generating means.

EXAMPLE III

The products packaged according to Example II were stored for 3 days at 40° F. and were then tested for percent of package free moisture, the results being reported in Table III.

TABLE III

| | Percent Package Free Moisture | | | |
|---|---|---|---|---|
| | Resizer B | | Control B | |
| | Mean | Standard Deviation | Mean | Standard Deviation |
| Product 6 | 0.38% | 0.11% | 0.59% | 0.21% |
| Product 7 | 0.45% | 0.10% | 0.79% | 0.18% |
| Product 8 | 0.49% | 0.21% | 0.84% | 0.28% |
| Product 9 | 0.42% | 0.10% | 0.79% | 0.14% |
| Product 10 | 0.39% | 0.08% | 0.73% | 0.24% |

The percent of package free moisture was actually found to be higher in the products closed using Control B. This result is believed to be due to the fact that these packages contained more buckled and paneled packages with the result that, after temperature equilibrium, the buckled and paneled areas became filled with meat juices thereby increasing the level of package free moisture. Resizer B substantially eliminated buckled and paneled packages and, therefore, the amount of package free moisture is reduced.

Those skilled in this art will recognize that the present invention can be embodied in various forms. Accordingly, this invention is to be construed and limited only by the scope of the appended claims.

We claim:

1. A method for pressure resizing a shaped stack of food product slices into substantial conformity with the inside surface of a preformed package having a deformable plastic body member including a side wall and an end wall, the package also having a closure panel opposite the end wall, the shaped product being arranged in the form of a mass having a side surface, an end surface and a closure surface opposite the end surface, the method comprising:

placing the stack of food shaped product slices into a pressure resizing cavity having a non-resilient side wall restraint member, said pressure resizing cavity having a cross section transverse to its side wall that is substantially the same size and shape as that of the transverse cross section of the deformable plastic body member of the package such that there is substantially no gap between the non-resilient side wall restraint member and the side wall of the package plastic body member, said transverse cross section size of the package plastic body member being greater than that of the transverse cross section of the shaped product;

applying force contact and to restrain substantially the entire closure surface of the shaped product while the shaped product is within the cavity; and applying a force to said end surface of the shaped product by using a force applying surface in operative engagement with said shaped product end surface, said applying step being carried out while there are substantially no gaps between the force applying surface and the end wall of the package body member, this applying step including actively applying pressure to the end surface and closure surface of the stack of food product in order to longitudinally compress and laterally expand the shaped product to have a transverse cross section substantially the same as that of the side wall of the package body member, whereby the shaped product is pressure resized by a restrained cavity concept to conform substantially to the size and shape of the cavity without any significant deformation of the deformable plastic body member, whereby packaging defects including paneling, buckling and dishing are substantially avoided.

2. A method as defined by claim 1 wherein the step of placing the product into the cavity includes inserting the package body member into the cavity, placing the package body member and product into the cavity, and closing the package body member with the closure panel.

3. A method as defined by claim 2 wherein the step of applying a force to the product is initiated substantially simultaneously with initiation of the step of applying a force to restrain the closure surface of the product.

4. A method as defined by claim 1 wherein the step of applying a force to restrain the closure surface of the product is carried out generally simultaneously with a step of closing the package body member with the closure panel.

5. A method as defined by calim 1 wherein the resizing operation is carried out prior to closing the package body member with the closure panel.

6. A method as defined by claim 1 wherein the resizing operation is carried out subsequent to closing the package body member with the closure panel.

7. A method as defined by claim 1 and further including a step of closing the package body member with the closure panel, the closing step including an air evacuation step and a hermetic sealing step.

8. A method as defined by claim 1 wherein the product is a stack of sliced luncheon meats.

9. A method as defined by claim 1 wherein the package is a preformed flexible plastic package.

10. A method as defined by claim 1 wherein the package is a preformed semi-rigid plastic package.

11. A method as defined by claim 1 wherein the package is a preformed rigid plastic package.

* * * * *